US010518570B1

(12) United States Patent
Gilman

(10) Patent No.: US 10,518,570 B1
(45) Date of Patent: Dec. 31, 2019

(54) WHITE PLASTIC SHEET WITH LOW METAMERISM

(71) Applicant: The Gilman Brothers Company, Gilman, CT (US)

(72) Inventor: Evan Gilman, Gilman, CT (US)

(73) Assignee: The Gilman Brothers Company, Gilman, CT (US)

( * ) Notice: Subject to any disclaimer, the term of this patent is extended or adjusted under 35 U.S.C. 154(b) by 0 days.

(21) Appl. No.: 15/369,080

(22) Filed: Dec. 5, 2016

Related U.S. Application Data

(63) Continuation-in-part of application No. 14/666,956, filed on Mar. 24, 2015, now abandoned.

(60) Provisional application No. 61/976,088, filed on Apr. 7, 2014.

(51) Int. Cl.
*B41M 5/52* (2006.01)
*B41M 5/50* (2006.01)

(52) U.S. Cl.
CPC ..... *B41M 5/52* (2013.01); *B41M 5/504* (2013.01); *B41M 5/508* (2013.01); *B41M 5/5218* (2013.01); *B41M 5/5227* (2013.01); *B41M 5/5254* (2013.01); *B41M 2205/34* (2013.01); *B41M 2205/36* (2013.01)

(58) Field of Classification Search
CPC ..... B41M 5/50; B41M 5/5508; B41M 5/52; B41M 5/5218; B41M 5/5227; B41M 5/5254; B41M 5/508; B32B 27/08; B32B 27/18; B32B 27/20; B32B 27/30; B32B 27/302; B32B 27/308
USPC ..... 428/195.1, 516
See application file for complete search history.

(56) References Cited

U.S. PATENT DOCUMENTS

| | | | | |
|---|---|---|---|---|
| 5,714,287 | A * | 2/1998 | Malhotra | B41M 7/0027 156/230 |
| 6,864,023 | B2 * | 3/2005 | Aylward | B41M 5/41 347/106 |
| 2005/0013986 | A1 * | 1/2005 | Buechler et al. | B32B 3/26 428/304.4 |
| 2006/0068133 | A1 * | 3/2006 | Khoultchaev | B41M 5/506 428/32.34 |

* cited by examiner

*Primary Examiner* — Gerard Higgins
(74) *Attorney, Agent, or Firm* — Alix, Yale & Rista, LLP

(57) ABSTRACT

A metamerism-resistant printable plastic sheet, especially white sheet, in which the desired shade of white can be easily specified or adjusted. This is achieved by separately controlling the opacity and the brightness. The opacity is controlled by the concentration of white pigment in a plastic base layer and the brightness is controlled by the concentration of an optical brightener in a plastic print layer bonded to, and preferably coextruded with, the base layer. Such a sheet can be bonded to one or both sides of a rigid core to create a graphics board, or used as a stand-alone flexible print sheet. Preferably, the plastic print layer comprises a polymer resin that is inherently resistant to a yellowing reaction from exposure to UV light.

22 Claims, 1 Drawing Sheet

WHITE PLASTIC SHEET WITH LOW METAMERISM

RELATED APPLICATION

This application is a continuation-in-part of U.S. application Ser. No. 14/666,956 filed Mar. 24, 2015 for "White Plastic Sheet With Low Metamerism", which claims priority under 35 U.S.C. § 119(e) of U.S. Provisional Application No. 61/976,088 filed Apr. 7, 2014 for "White Plastic Sheet with Low Metamerism."

BACKGROUND

This present invention relates to white sheet and boards for the printing and display of graphics in commercial and retail signage.

Printing technology has made major advancements over the years in both software and hardware to allow for a safer more consistent way to reproduce graphics in various printing platforms. Heavy metals have been taken out of the inks and safer solvents along with water based inks and ultra violet curing has changed the press room. Flatbed UV printers have been added to sheet and roll fed presses. These new digital flat presses can print on large rigid sheets with dimensions of 4'×8'×1" and larger. Major applications for these large flat lightweight signs are for interior retail graphics. These signs can be seen at many large retailers such as anchor stores in shopping malls, supermarkets, and the like. There are many different store locations for graphics. Some locations are high in the air and require large rigid self-supporting panels while other locations may require thin flexible materials to slide into a frame. One thing that is critical is a brilliant white colored substrate to print on. For the most part most of the inks used in the printing process have a degree of transparency and the ability of the color to pop is due to the white paper reflecting light back through the ink. Not only will the white substrate give the ink some of its brightness but it will also influence the color of the ink unless the colors are dark and opaque. Small changes in the substrate's white shade and brightness will sometimes have dramatic changes on the colored inks appearance both from a visual perspective and spectral data curve.

The preferred white color for a particular application or customer may vary from warm to cool, however once a color of white is selected it is critical that the white be consistent for that job or customer or application. If the white varies then the color and appearance of the printed material will vary and not look the same. When company logos and colors are printed they must look the same time and time again and on specification.

Companies will also use different types of print substrates depending on the application. Some graphics are long term signage as others are short term and disposable. Plastic (e.g., polystyrene) may work for more permanent signage where clay coated paper faced composite boards may be for short term use. Paper faced and plastic faced rigid boards are the main substrates used in the aforementioned applications. The core of these laminated boards may be cellular foam or paper honeycomb. From a manufacturing perspective it is not easy to have different types of materials (paper, plastic) match in white color. However it is very important to be consistent color from printing both and having them in the same location.

One can appreciate that the white color in a plastic sheet is accomplished by incorporating a white pigment (i.e.,$TiO_2$) into the resin during the extrusion process for a homogeneous dispersed color. For the paper sheet version of the paper faced board the paper fibers are bleached to a white color and white pigments and additives may be dispersed in the wet end of the paper machine into the fiber matrix and in many cases a white pigmented clay based coating containing $TiO_2$, calcium carbonate, and optical brightener is coated on one or two sides of the sheet.

With some effort one can come close to having the same shade of white color on both the plastic and paper sheet as long as one uses a specific light source to view the two (paper and plastic) and match the two during manufacturing using that one light source.

It is well known in the industry and the retail environment that the color of an item can change dramatically when taken outside or into different lighting environments (i.e. daylight, incandescent, fluorescent, halogen, mercury vapor-convention hall). The real challenge as outlined above is to have the paper and plastic sheet matched in manufacturing for viewing under perhaps a standard D50 proofing illuminant, also match under all the different light sources mentioned above. This task has been very challenging for a number of reasons.

Optical brighteners (hereinafter, OB) are also known as florescent whitening agents. These additives are put into almost all white papers and many white plastic consumer products to make them appear whiter and brighter. These optical brighteners absorb invisible ultraviolet light in the 300-400 nm range and make it re-emit or fluoresce in the blue region of the visible spectrum peaking at 435 nm. This effect will compensate for a yellow tint of many types of white paper pulps that have been bleached and plastic resins with a yellowish cast present in the base resin or visible due to high heat during post processing or with the addition of additives as UV absorbers light stabilizers, processing aids, antioxidants, lubricants, heat stabilizers, surface modifiers, and fillers. It would be difficult to find a white paper from a paper mill that did not have optical brighteners; if it had no OBs it would have a yellow tint and not be suitable for printing display graphics and most other printing applications.

Papers and plastics with optical brighteners will appear to change in color based on the amount of UV light emitted by the viewing light source and the amount of OBs in the paper and plastic and their ability to fluoresce based on the chemistries of the products (i.e. pigments, additives) that may compete with the OB to quench their effect.

Optical brighteners are used in the paper and plastic industries to mask the yellow nature of many bleached paper fibers and thermoplastic resins used in the household article and packaging industries. Some of these applications are in clear resins and colorless items while others are white pigmented articles. The differences in concentration levels of optical brightener between the clear OB resin product and the white pigmented product can be 50 plus times greater in white than clear. Since the cost of the optical brighteners can be 20 times or more the cost of the base plastic resins or paper pulp attention must be given to the method of use and affordability.

The appearance of a typical optical brightener in its raw manufactured state is a yellow crystalline powder. One must not overdo the level of use and thereby defeat the reason for its use in the first place.

White plastic sheet in the range of 0.010-0.080 inch (10-80 mils) would be typical for the aforementioned plastic to be laminated to the two sided foam board or used as a single flexible plastic print sheet. These sheet materials must exhibit strong opacity so graphics printed on both sides of the sheet would not show through if displayed in a retail environment. This requirement would dictate a high loading of pigment with $TiO_2$. Since $TiO_2$ has a slight yellow tint and the preferred resin for the rigid board and flexible sheet application is polystyrene with its own yellow cast one can see that the optical brightener, the pigment, and the resin all push the extruded plastic sheet to a slightly yellow shade. One can compensate by adding a small amount of blue or violet colorant into the resin to mask the yellow. This tends to cut back on the brightness and makes the white a bit dirty.

The greater the amount of $TiO_2$ one loads into the resin the less positive effect OBs will have of masking a yellow shade in the sheet. This is due to the interference and masking effect of the $TiO_2$ not allowing the OB to be absorbed and fluoresce. The more OB added to the sheet to compensate for the high loading of $TiO_2$, the more a yellow tint appears in lighting environments with minimal UV light present.

An additional problem occurs when a plastic print sheet is displayed in sunlight, or for extended periods in artificial light. The UV light component can not only provide the advantage of interacting with the OB to enhance brightness, but also raises the disadvantage of reacting with the resin polymers to produce an unwanted yellowing that is quite visible to the observer.

SUMMARY

Given the foregoing difficulties, one object of the invention is to provide a white plastic sheet in which the particular shade of white can be easily specified or adjusted. Another object is to generalize this to color control of non-white, i.e., shaded or tinted sheets.

This is achieved by separately controlling the opacity and the brightness. The opacity is controlled by the concentration of pigment in a plastic base layer and the brightness is controlled by the concentration of an optical brightener in a plastic print layer bonded to, and preferably coextruded with, the base layer. Such a sheet can be bonded to one or both sides of a rigid core to create a graphics board, or used as a stand-alone flexible print sheet.

Thus, a method embodiment comprises manufacturing a printable sheet by coextruding an unpigmented thermoplastic resin print layer with dispersed optical brightener onto a pigmented base layer.

In the preferred embodiment, the resulting printable white plastic sheet comprises a base layer containing white pigment and an unpigmented plastic print layer containing an optical brightener, bonded to the base layer. Preferably, the base layer is opaque white plastic and the print layer is plastic with dispersed optical brightener.

Surprisingly, not only can a target white shade or other color be easily achieved, but the target shade experiences minimal visual color shift from one lighting source to another (metamerism) commonly encountered in a retail or industrial environment.

Another object is to easily match the white color of a commonly used clay coated optically brightened paper stock (e.g., Mead-Westvaco CIS Tango Advantage Paper, hereinafter, "Tango") that is used in the manufacture of paper faced foam board, but with a plastic sheet facer version that exhibits similar minimal shifts in color when exposed to the many different lighting environments (i.e., tungsten, florescent-cool, warm, -daylight-full spectrum, halogen, mercury vapor, interior exposure to window outdoor lighting conditions).

One embodiment of this method includes comparing the white color of the first plastic sheet with the white color of the paper sheet. If the compared white colors are not within a target tolerance, a second plastic sheet of different composition is produced by coextruding a second unpigmented thermoplastic resin print layer containing optical brightener onto a second white pigmented base layer, wherein one or both of the wt % optical brightener in the print layer and the wt. % pigment in the base layer are different from the corresponding wt. % in first plastic sheet. A comparison is made again, and if the compared white colors are not within the target tolerance, the foregoing steps are repeated repeating until the white colors are within the target tolerance.

Another object is to create a printable product line of substrates that would all have a similar white shade of color so a graphics printer need not change the color management workflow and procedures when alternating between paper faced board products and plastic faced board products.

The human eye perceives a smaller change of color on a white material compared to other, saturated colors. Another color printed on white will appear as different colors on different white print surfaces due to the transparent nature of the new inkjet inks. It is not enough that the two different print surfaces (paper and plastic) look the same under a D50 proofing light or the environment where they are initially viewed and printed, but they should look similar when viewed in their permanent display space with whatever light source and color temperature are present.

As a preferred embodiment for a printable sheet, display board or similar display panel, especially for display in sunshine, the print layer is selected from a plastic such as an acrylic that does not react in the UV wavelength in a way that induces significant yellowing. The yellowing index should be less than 5, preferably less than 3.

DETAILED DESCRIPTION

The preferred embodiment, for producing a white sheet, will be described in detail but it should be appreciated that the key feature of separating opacity from brightness can be implemented in a non-white context.

Figure 1:
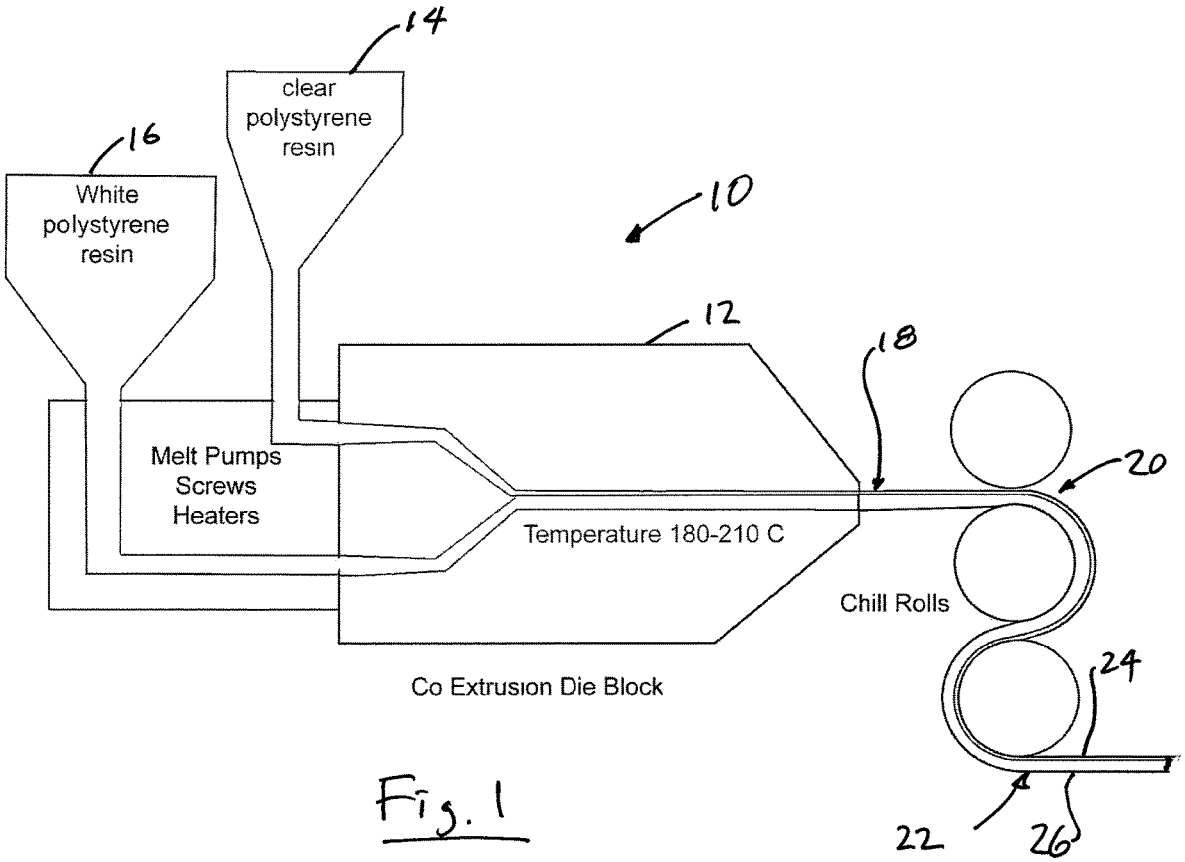
FIG. 1 schematically shows equipment for coextruding an unpigmented thermoplastic resin print layer with dispersed optical brightener onto a pigmented base layer and the resulting printable sheet.

FIG. 1 shows an extrusion system 10 including a coextrusion die block 12 supplied by a source 14 of clear (unpigmented) thermoplastic polystyrene resin with dispersed optical brightener and another source 16 of white pigmented thermoplastic polystyrene resin, at a temperature in the rage of about 180-210 deg. C. The hot coextruded laminate 18 is chilled between rollers 20 to produce the printable sheet 22 consisting essentially of a clear resin print layer 24 with dispersed optical brightener bonded to a white pigmented base layer 26.

Figure 2:
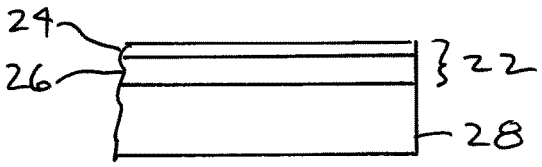
FIG. 2 shows the printable sheet bonded to a mounting substrate such a foam board.

FIG. 2 shows the printable or printed white sheet 22 in an end use context, bonded to a relatively rigid foam board 28 or the like.

The discovery at the core of the present invention was arrived at after extensive trials and re-trials that eventually deviated from conventional thinking in the graphics industry. Initial trials were conducted to determine whether white color matching and low metamerism could be achieved with no optical brightener in a white single layer extruded polystyrene sheet. Color was matched against the target Tango paper color under a D50 proofing light source, but when the light source and color temperature changed the color comparison based on a visual perception was no longer a match. Further trials were based on compounding an optical brightener at various loading levels into the pigmented polystyrene white resin to achieve these two objectives. Both anatase and rutile types of $TiO_2$, were tested to determine if any one was a better candidate for success. It became clear that these objectives could not be achieved with the simple standard solution of a direct addition of OB into a white extruded resin. The test samples were either too bright or white when viewed under lighting conditions with high UV irradiance (i.e., daylight) or too yellow when viewed under lower color temperature light sources.

The solution was achieved by bonding, e.g., coextruding, a white pigmented plastic base layer with a top print layer of clear (translucent) resin containing homogeneously dispersed OB. The OB can be in the range of about at 0.01 wt. %-0.10 wt. % of the print layer and the base layer can contain about 1-30 wt. % white pigment, e.g., $TiO_2$. The thickness of the print layer can be in the range of about 2%-50% of the total thickness of the composite plastic sheet.

This approach allows one to make the base layer in the co-extrusion as opaque as needed using any amount of the brightest (rutile) version of $TiO_2$, without the yellowing of a high loading of OB. With the cost of OB source material much greater than the cost of plastic sheet resin, there is also a significant cost advantage achieved by the need for only a low concentration of OB. This separation of brightness control from opacity control provides the ability to cost-effectively manufacture the kind of opaque plastic sheet demanded by the graphics printing industry.

The optical brightener is a yellow crystalline substance and as a consequence imposes a limit on how much can be added into a resin before an undesirable yellow tint is perceived. By adding the OB into a clear co-extruded layer with no $TiO_2$ masking, effective loading levels relative to a mono-sheet are much reduced with no increase in yellow color from the OB. The print layer with OB will appear as a clear translucent film before it is bonded to the base layer.

Another advantageous aspect of separating brightness control from opacity control is the ability to make a very bright white sheet by the independent adjustment of either one or both of the color of the base white sheet or the addition of a greater amount of OB into the top viewing layer. This level of whiteness and brightness under different lightening conditions is not possible by merely adding OB into single layer of white-pigmented resin.

It should be appreciated that a thin opaque plastic sheet is not amenable to brightening by incorporating an OB due to the high loading of $TiO_2$ required to achieve minimum opacity. This is not a problem for brightening thick pigmented sheets such as used for the inside panels of appliances such as refrigerator, where the sheet might be ten times thicker than facing for graphics mounting boards. With a thick sheet, the $TiO_2$ loading can be very low to achieve the same apparent opacity, so the low surface concentration of $TiO_2$ does not significantly mask the effectiveness of the OB.

So-called "delta-E" and "b* Value" calculations are well known in the graphics industry for characterizing color. The accompanying TABLE A clearly show that Sample #3 (New co-extruded plastic sheet according to the present invention) is far superior in matching the color of the Tango white paper and with far less metamerism under the various light sources used for the measurements.

CIE LAB calculations reported in TABLE B clearly show that Sample #4 (New co-extruded plastic sheet according to the present invention) is far superior in matching the b* value (an indicator of an OB effect) of the Tango control paper.

The tendency of a white colored object to change color in different lighting environments is significant. This metameric shift in white will have a tendency to display toward yellow. This is shown in TABLE A by the range of values for each different white sample under four different light sources. The average range of all the Samples except #3 is 0.9 to 1.2. This is an indication of significant color shift (metamerism). Sample #3 is the invention and shows a much lower value of 0.4 (lower metamerism). Such low metamerism can be achieved for white color targets at least within the white color range of most commercial foam board.

In order to look at a specific color shift, TABLE B shows the b* value in the CIE LAB color space where negative b* is blue and positive b* is yellow. Note the Tango white paper value of −4.35 and the inventive Sample #4 value at −4.13 are similar and show much more in the blue spectrum than all the other samples. These two samples contain an optical brightener and the OB is what is responsible for the shift into the blue range. This fluorescence of the OB is the mechanism that masks the yellowness of the white $TiO_2$ pigmented layer and since the small concentration of OB (0.05 wt. %) added to the top clear layer in adds no color to the white pigment it is an indirect, invisible way to tint or color the white base layer. In a traditional white color of a single layer product one would add a tinting blue/purple dye or pigment into the white resin prior to extrusion to mask the yellowness. This method will lower the brightness of the white color and has a tendency to add other undesirable qualities as muddiness to the color.

The apparent brightness of the white color that contains an OB may change based on the amount of UV emitted by the light source. However, the white color will not take on the degree of yellowness seen with a non-OB enhanced white sample. There is some degree of UV light in most of the common lighting environments to which these products are exposed and enough to activate the OB and counter the tendency to take on a color shift. The new novel way (co-extrusion of a clear translucent OB print layer on a white pigmented base layer), is a cost-effective solution to achieve low metameric shift in the color of a white plastic film sheet.

The tests as reported in TABLES A and B were performed under the following conditions:

Foam board: polystyrene foam core with paper or plastic facers.

Facers: 10-15 mils attached to the foam core by extruded adhesives (1 mil of adhesive).

Foam core: core-density 2-10 lb./ft3; thickness 0.060-2.0 inches.

Paper facers: Mead Westvaco 10-15 mil Tango Advantage white clay coated paper containing OB on test side.

Plastic facers: High Impact Polystyrene (HIP).

Duraplast: Plastics foam board (Gilman Bros.) with 12 mil HIPS polystyrene sheet with no OB.

New: Inventive foam board (Gilman Bros.) with 12 polystyrene sheet with 0.05% wt. OB Navapal (Sunbelt Corp.) powder in the 3.0 mil top layer only (2,5-Thiophenediylbis(5-tert-butyl-1,3-benzoxazole).

TABLE A

Delta-E Calculations on X-Rite Unfiltered spectrophotometer Control Specimen 10 PT. Tango Advantage White Paper by MeadWestvaco.

| | | D-50 | Incan-descent | Day-light | Florescent | Average | Range |
|---|---|---|---|---|---|---|---|
| 1. | Duraplast No OB | 3.8 | 3.1 | 4.0 | 3.4 | 3.6 | 0.9 |
| 2. | Duraplast color match No OB | 3.9 | 3.0 | 4.1 | 3.8 | 3.7 | 1.1 |
| 3. | New Top side measurement 0.05 wt. % OB in top layer | 1.0 | 0.7 | 1.1 | 0.7 | 0.9 | 0.4 |
| 4. | New Bottom side measurement No OB | 5.1 | 4.5 | 5.4 | 5.3 | 5.1 | 0.9 |
| 5. | United Ultra No OB | 5.0 | 4.2 | 5.2 | 4.8 | 4.8 | 1.0 |
| 6. | United DP No OB | 4.0 | 2.8 | 3.6 | 3.9 | 3.6 | 1.2 |
| 7. | 3A Smart-X | 6.2 | 5.4 | 6.6 | 6.3 | 6.1 | 1.2 |

Smart-X is a trademark of 3M Composites and Ultra and Ultra DP are trademarks of United Industries. This study compares the measured difference in color from a control white paper (Tango used by Gilman as Insite foamboard facers) to various polystyrene faced foam board products in the market under various lighting conditions. Industry standards for a color match vary however Pantonecolor systems recommends <2-3 delta-E points. For colors as Grey and White lower delta-E values would be recommended as one can see differences as little as 0.5 under certain conditions. It should be noted Item #3 New has the lowest delta-E by far of all tested products.

TABLE B

CIE LAB Color Measurements on an X-Rite Spectrophotometer

Blue (-) ◄- - - - - - - - b* Value - - - - - - - - ► (+) Yellow

| | | D-50 Proofing Illuminant |
|---|---|---|
| 1. | Tango Advantage White Paper Yes OB | −4.35 |
| 2. | Duraplast No OB | −2.91 |
| 3. | Duraplast color match No OB | −1.46 |
| 4. | New Top side measurement 0.05 wt. % OB in top layer | −4.13 |
| 5. | New Bottom side measurement No OB | 0.31 |
| 6. | United Ultra No OB | −2.30 |
| 7. | United DP No OB | −1.56 |
| 8. | 3A Smart-X | 0.53 |
| 9. | Sample 1213 one layer film sample 0.022% OB dispersed in the entire sample | −2.41 |
| 10. | Sample 1214 One layer 0.011% OB Dispersed in entire sample | −1.67 |

Sample #4 New comes very close to matching Tango white paper sample. The backside of New Sample #5 with no OB is very yellow. When the clear layer is co-extruded note the improvement in Sample #4. Sample #9 with OB in a single layer film is not as blue as Sample #1 or #4.

It should be appreciated that the base layer provides the opacity, determined by the pigment loading, but this does not preclude the presence of other material. The plastic print layer provides the brightening effect to the underlying opacity of the base layer, without interfering significantly with the underlying pigmentation. The print layer can thus include low levels of dye or pigment, for tinting (shading), so long as the print layer remains transparent or translucent. Thus, the print layer can be considered as clear-to-translucent. In most contexts, however, the base layer would not contain an optical brightener and the print layer would be clear, i.e., without any tinting agent.

It should be further appreciated that although the print layer of the sheet will normally have an exposed, printable surface, the base layer could be sandwiched between the print layer and another plastic layer. Also, the sheets could be bonded other than by coextrusion, including coating or laminating.

The delta E values in Table A indicate differences among different kinds of printable sheets under different light conditions. Delta E can also indicate the extent of color change of a given print sheet over time. Delta E for a given sheet can be especially large as a result of print layer exposure to sunlight, and even long term exposure to many kinds of artificial light. To overcome this tendency according to an embodiment of the present invention, the material used to extrude the print layer can be selected from resins in which the polymers inherently do not exhibit a significant discoloration reaction with UV light. Acrylics are one such class of resins, in which the polymers are relatively immune to a yellowing reaction from exposure to UV light. Acrylics are generally more expensive that styrene, but some have similar extrusion processing characteristics.

Although it is known to add a so called "UVA package" to resins for the purpose of minimizing discoloration due to UV exposure, these additives absorb UV light and convert it to heat. If used with OB impregnated resins for a clear or tinted print layer according to the present invention, the additive would absorb UV while the OB relies on UV for the desired florescence. If the OB is more heavily loaded to overcome the counter effects of the UVA package, the powdered OB material itself begins to act like a yellow pigment, thereby discoloring the print layer.

As noted previously, two advantages of the present invention are that by separating the optically brightened print layer from the pigmented base layer, a bright white print sheet can be obtained with a relatively low OB loading and whiteness can be matched against other plastic or paper printable sheets. A further advantage of low OB loading in an inherently UV resistant print layer is resistance to yellow fading due to either or both of UV absorption and OB overload.

Therefore, in the preferred embodiment the resin of the print layer is inherently relatively insensitive to discoloration from UV exposure. Acrylic resins or resins containing acrylic compounds such as ASA (acrylonitrile styrene acrylate), would be effective in this regard as well as exhibiting compatibility with coextrusion of a pigmented polystyrene base layer and unpigmented, OB impregnated print layer. Examples include Solarkote H310M Acrylic from Altuglas International, Arkema Group, Bristol PA and GELOY ASA XTWE270M from Sabic Corporation, Houston, Tex.

Further guidance can be obtained from The Effects of UV Light and Weather on Plastics and Elastomers, by Laurence W. McKeen, (William Andrew, Inc. 2nd Edition, Copyright 2007). Data presented therein compares, inter alia, the delta E experienced by white ASA and white HIPS (high impact styrene), in Florida sun for a period of 12 months. The delta E for the HIPS was approximately 15, whereas the delta E for the ASA was approximately 2. Similarly, a comparison made according to the ASTM D1925 standard, shows that after two years of equivalent weathering, a simple polycarbonate exhibited a yellowness index of 10, a polycarbonate with UVA package exhibited an index of over 3, whereas the index for an untreated acrylic was less than one. Yellowness index is a type of laboratory measurement (the b value) where the higher the number the more yellow the color. ASTM D1925 was withdrawn in 1995, but the experimental results are still valid for present purposes. For the preferred embodiment, the print layer should comprise a resin that has an inherent yellowness index lower than 5, especially lower than 2.

As another example of a suitable print layer, some natural ASA resin is not transparent and has a cream haze. It can still be used for the print layer if a light impregnation of TiO2 pigment is used (2-15 wt. %) with a blue dye to make the resin white before impregnation with OB. If the print layer is made white translucent with a low degree of opacity then the OB would work without being countered with a higher loading of TiO2. No UVA would be needed. This should have a good non-yellowing light exposure rating, similar to an acrylic.

It should be appreciated that the basic concept of separating the opacity from the brightness in a respective two plastic layers can be implemented in a preferred embodiment, where no brightener is in the opaque layer and no pigment is in the brightened layer. However, slight variations where brightener and pigment are in the same layer, which nevertheless achieve equivalent functionality and provide similar advantages not available in the prior art, are encompassed within the broad scope of the present invention.

The invention claimed is:

1. A rigid display board comprising a flat, rigid cellular foam core and a printable sheet bonded to the cellular foam core, wherein the printable sheet comprises: a base layer containing pigment and an unpigmented plastic print layer containing an optical brightener in this order on the cellular foam core, and wherein the print layer is bonded to the base layer.

2. The rigid display board of claim 1, wherein the base layer is opaque white plastic and the print layer is unpigmented plastic with dispersed optical brightener.

3. The rigid display board of claim 1, wherein the base layer is a polystyrene containing $TiO_2$ pigment and the print layer is clear-to-translucent polystyrene containing a fluorescent optical brightener.

4. The rigid display board of claim 1, wherein the sheet has a thickness in the range of about 10-80 mils;

the base layer is an opaque plastic containing $TiO_2$ pigment;

the print layer is a clear-to-translucent plastic with homogenously dispersed optical brightener that absorbs UV light in the invisible range of 300-400 nm and fluoresces in the visible range.

5. The rigid display board of claim 4, wherein the print layer has a thickness in the range of 2%-50% of the thickness of the sheet.

6. The rigid display board of claim 5, wherein the print layer is a clear-to-translucent resin with a fluorescent optical brightener constituting 0.01 wt. % to 0.10 wt. % of the print layer;

the base layer is pigmented with $TiO_2$ in the range of about 1 wt. % to 30 wt. % of the base layer.

7. The rigid display board of claim 1, wherein the foam core has opposite flat sides and one of said printable sheets is bonded to each side of the core.

8. The rigid display board of claim 1, wherein the sheet consists essentially of a base layer that is non-white opaque plastic and a print layer that is plastic with dispersed optical brightener.

9. The rigid display board of claim 1, wherein the base layer is a polystyrene containing non-white pigment and the print layer is clear-to-translucent polystyrene containing a fluorescent optical brightener.

10. The rigid display board of claim 1, wherein the sheet has a thickness in the range of about 10-80 mils;

the base layer is non-white pigmented plastic;

the print layer is a clear-to-translucent plastic with homogenously dispersed optical brightener that absorbs UV light in the invisible range of 300-400 nm and fluoresces in the visible range.

11. The rigid display board of claim 1, wherein the print layer has a thickness in the range of 2%-50% of the thickness of the sheet.

12. The rigid display board of claim 1, wherein the print layer is tinted.

13. The rigid display board of claim 1, wherein the print layer is translucent.

14. The rigid display board of claim 1, wherein the base layer consists essentially of a pigmented plastic without optical brightener and the print layer consists essentially of clear plastic with optical brightener.

15. The rigid display board of claim 1, wherein the print layer has a yellowing index of less than 5.

16. The rigid display board of claim 15, wherein the print layer consists essentially of a polymer resin which has an inherent yellowing index of less than 5.

17. The rigid display board of claim 16, wherein the print layer consists essentially of a polymer resin which has an inherent yellowing index of less than 3.

18. The printable sheet of claim 15, wherein the printable sheet has a thickness in the range of about 10-80 mils.

19. A rigid display board comprising:

a flat, rigid cellular foam core and a printable sheet bonded to the cellular foam core, wherein the printable sheet comprises a base layer containing pigment and an unpigmented plastic print layer containing an optical brightener in this order on the cellular foam core, and wherein the print layer comprises an acrylic resin and is bonded to the base layer.

20. A rigid display board comprising a flat, rigid cellular foam core and a printable sheet bonded to the cellular foam core, wherein the printable sheet consists of a base layer containing TiO2 pigment without optical brightener, and an unpigmented plastic print layer containing an optical brightener at a concentration of 0.01 wt. % to 0.10 wt. % of the print layer in this order on the cellular foam core, and wherein the print layer is bonded to the base layer.

21. The rigid display board of claim 20, wherein the print layer comprises an acrylic resin.

22. The rigid display board of claim 20, wherein the print layer is white, constituted from a cream-hazed ASA resin impregnated with TiO2 pigment, and a blue dye.

* * * * *